US009067645B2

(12) United States Patent
Reines et al.

(10) Patent No.: US 9,067,645 B2
(45) Date of Patent: Jun. 30, 2015

(54) SUPPORT OF TANKS IN VESSELS

(71) Applicant: Brevik Technology, A.S., Brevik (NO)

(72) Inventors: Arnt Halvar Reines, Sandfjord (NO); Jacob Ivar Jacobsen, Porsgrunn (NO)

(73) Assignee: Brevik Technology, A.S., Brevik (NO)

( * ) Notice: Subject to any disclaimer, the term of this patent is extended or adjusted under 35 U.S.C. 154(b) by 0 days.

(21) Appl. No.: 13/705,612

(22) Filed: Dec. 5, 2012

(65) Prior Publication Data

US 2013/0092073 A1 Apr. 18, 2013

Related U.S. Application Data

(63) Continuation of application No. PCT/NO2011/000177, filed on Jun. 18, 2010.

(51) Int. Cl.

| | |
|---|---|
| ***B63B 25/08*** | (2006.01) |
| ***B63B 3/70*** | (2006.01) |
| ***B63B 11/04*** | (2006.01) |
| ***B63B 25/12*** | (2006.01) |
| ***B63B 25/16*** | (2006.01) |
| ***F17C 13/08*** | (2006.01) |
| *B63B 25/14* | (2006.01) |

(52) U.S. Cl.

CPC . *B63B 11/04* (2013.01); *B63B 3/70* (2013.01); *B63B 25/12* (2013.01); *B63B 25/14* (2013.01); *B63B 25/16* (2013.01); *B63B 2025/087* (2013.01); *B63B 2231/34* (2013.01); *F17C 13/082* (2013.01); *F17C 2201/0109* (2013.01); *F17C 2201/0119* (2013.01); *F17C 2201/032* (2013.01); *F17C 2201/035* (2013.01); *F17C 2201/052* (2013.01); *F17C 2205/013* (2013.01); *F17C 2205/018* (2013.01); *F17C 2205/0192* (2013.01); *F17C 2221/013* (2013.01); *F17C 2221/033* (2013.01); *F17C 2223/0153* (2013.01); *F17C 2260/033* (2013.01); *F17C 2270/0105* (2013.01)

(58) Field of Classification Search

USPC ..... 114/74 A

See application file for complete search history.

(56) References Cited

U.S. PATENT DOCUMENTS

| | | | | |
|---|---|---|---|---|
| 3,071,094 | A | 1/1963 | Leroux | |
| 3,583,352 | A * | 6/1971 | Alleaume | 114/74 A |
| 2012/0055920 | A1 | 3/2012 | Rekstad | |

FOREIGN PATENT DOCUMENTS

WO 2010020431 A1 2/2010

OTHER PUBLICATIONS

International Search Report, International Application No. PCT/NO2011/000177.

International Preliminary Report of Patentability, International Application No. PCT/NO2011/000177.

* cited by examiner

*Primary Examiner* — Stephen Avila

(74) *Attorney, Agent, or Firm* — Richard A. Fagin

(57) ABSTRACT

A system for support of a vertical cargo tank resting on an insulation layer against the hull of a vessel is arranged such that vertical forces are supported through the base of the tank. Horizontal forces are supported by support point pairs. These pairs are designed to direct applied forces generally through the middle of the shell of the tank in order not to apply bending moment to the shell of the tank. The base of the tank is flexible to generally distribute transferring forces from the tank directly to the bottom of the vessel in order not to apply bending moment to the shell of the tank or to the bottom of the vessel.

3 Claims, 9 Drawing Sheets

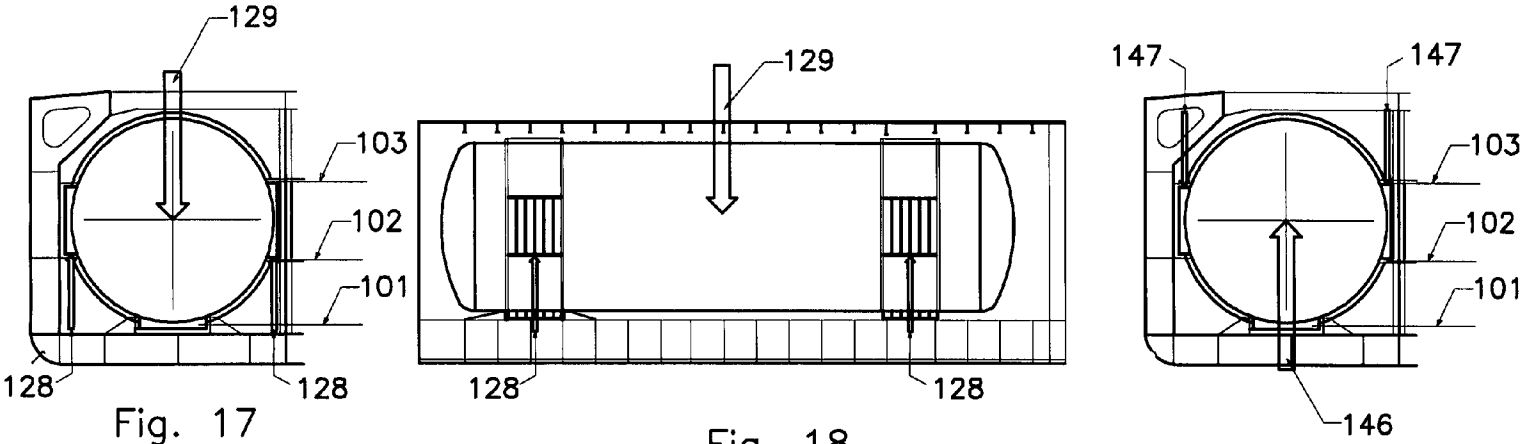
Fig. 17
Fig. 18
Fig. 19
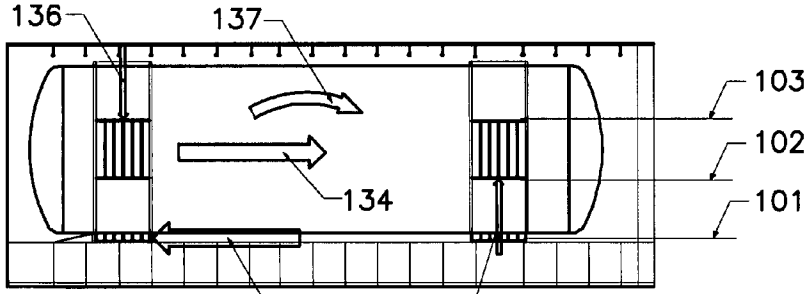
Fig. 20
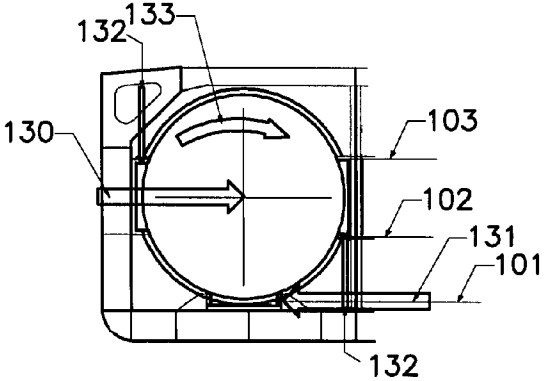
Fig. 21

SUPPORT OF TANKS IN VESSELS

CROSS REFERENCE TO RELATED APPLICATIONS

This is a continuation of International Application No. PCT/NO2011/000177 filed on Jun. 20, 2011. Priority is claimed from Norwegian Patent Application No. 20100881 filed on Jun. 18, 2010 and Norwegian Patent Application No. 20101555 filed on Nov. 4, 2010. All of the foregoing applications are incorporated herein by reference in their entirety.

STATEMENT REGARDING FEDERALLY SPONSORED RESEARCH OR DEVELOPMENT

Not Applicable

BACKGROUND

The present disclosure relates to a system for the support of tanks for liquids in vessels. More particularly the disclosure relates to a system for bearing or support of vertical forces on tanks for liquids in vessels at the base of the tanks and for horizontal forces at few places so that the bearing of forces that arise are transferred in an advantageous manner to the construction of the vessel.

It is advantageous that the capacities of a ship are exploited in the most efficient way while safety is maintained. The design and therefore the fastening of tanks thereto are influenced by the liquid that is to be transported. This is influenced by the environment that the liquid requires. Liquids that are to be transported may be, for example, foodstuffs that require cooling in order to maintain quality, while other liquids require an over- or under-pressure. An energy carrier such as a liquefied natural gas (LNG) transport vessel requires a tank having a storage temperature of around −160° C. at atmospheric pressure. For carbon dioxide ($CO_2$) transportation, a requirement is, for staying fluent, a temperature of −60° C. in addition to a pressure of about 600 kPa. When transporting other liquids, other conditions apply. Together with dimensions and weight of such tanks, this lay the foundation for even minor improvements may result in large economic profit and competitive advantages.

In the art is known to use hardwood to transfer support forces from a tank to hull as pure pressure via hardwood layers or synthetic materials with similar properties. It is essential that the materials in these layers have very good temperature insulating properties and that they can endure the pressure that they are subjected to.

Hardwood is a suitable material for this purpose, but there are many synthetic alternatives. The products DEHONIT® and PERMALI, which are trademarks of the German company "Deutshe Holzveredlung Schmeing" are examples of products for such use.

Tanks intended for transport of liquids with boats are often formed as spheres, cylinders or prisms. U.S. Reissue Pat. No. RE 29424 describes supporting of tanks having a cylinder shaped cross section that rest on a skirt with opposite sides firmly fastened to a hull of a ship, claim 1. The '030 reissue patent describes another form of support, where a number of support units along a horizontal circumference of the tank is put into opposite positioned sleeves.

Vessels may also comprise high vertical cylinder shaped tanks. High tanks may be advantageous for transporting liquids because it will then have better opportunity to adapt the amount of liquid that may be transported with a given hull of a vessel. In addition there are of course other technical problems to addressed as a consequence of using such high tanks. An example of such consequences may be conditions regarding the stability of the vessel. Another and important example is the vertical and horizontal support of such high tanks.

International (PCT) Application Publication No. WO 2010/020431 describes a device for storing a self supporting vertical tank for LNG. It comprises a support arrangement that enables a horizontal relative motion between the tank and the foundation. In this way the tank may contract and expand according to the temperature of the tank without unwanted tension to appear.

The foregoing International Application also describes an arrangement with vertical support faces that are distributed evenly around the tank in two heights. In this way the tank is supported when horizontal forces are applied and pitching is prevented.

A disadvantage with self supporting big and high vertical tanks is that they result in large local load because it is not straightforward to distribute the load. Normally the load is either applied to a ring on the bottom of a ship or to the sidewalls of the hull of the ship. This is described in the '431 PCT publication.

There are mainly two different versions of cryogenic tank design for transport of LNG that are being used today. One is a self supporting tank while the other is a so called membrane type. The most common self supporting type is the Moss tank with a design owned by the Norwegian company Moss Maritime and is a spherical tank. One advantage with self supporting tanks like the Moss tank is that they are robust. One disadvantage is that they are not very efficient in that much space is wasted in the hull with spherical tanks.

The French company Gaz Transport & Technigaz (GTT) own some important designs of membrane type tanks. A membrane tank has a layer of corrugated metal that can maintain its proportions in a wide temperature range so that the tank can fill out the space inside a hull and thus rest on the inner bottom and on the walls of the hull. This results in a very efficient utilization of the space in a ship. Disadvantages of membrane tanks today are that they have a history of leakage and they are not as robust as self supporting tanks. Maintenance on membrane tanks therefore has to be done at frequent intervals and this adds to the cost of running such ships.

SUMMARY

A system for support of a cargo tank in a vessel according to one aspect include a cargo tank having a generally flat and generally flexible base. The system includes support elements substantially evenly distributed underneath the base of the tank. Each support element comprises an insulation layer transferring pressure generally evenly distributed from the contents of the tank, through the bottom structure of the vessel and on to water pressure exerted on an outer bottom of the vessel. The cargo tank comprises at least two pairs of tank pressure faces fastened to a tank shell, wherein at least one pair of the tank pressure faces is arranged transversely and wherein at least one pair of the tank pressure faces is arranged longitudinally in the vessel. An insulation layer is arranged proximate to each of the tank pressure faces.

A corresponding hull pressure face is arranged proximate to each of the insulation layers on the other side of each of the insulation layers. Each hull pressure face is fastened to a ship side or to a bulkhead, wherein each tank pressure face and each corresponding hull pressure face is aligned so that an orthogonal line of force is directed generally tangentially to a middle of the tank shell so that the insulation layers can transfer pressure without transferring substantial bending moment from the support loads to the cargo tank structure or to the bottom of the vessel and, at the same time, thermally insulate between the cargo tank and the vessel.

BRIEF DESCRIPTION OF THE DRAWINGS

FIG. 17 depicts a cross section crosswise, the applied vertical force and reaction force being shown.

FIG. 18 depicts a longitudinal cross section of the vessel in FIG. 11 presenting vertical applied force and reaction force.

FIG. 19 depicts a cross section crosswise, the vertical applied forces and reaction forces being indicated.

FIG. 20 depicts a cross section alongside the vessel 141, the longitudinally applied torque and longitudinal applied horizontal force and longitudinal reaction force being presented.

FIG. 21 depicts a cross section crosswise, the applied torque, crosswise force and crosswise reaction forces being indicated.

DETAILED DESCRIPTION

A support system for different shapes of load tanks in vessels like carrier ships and storage ships is described. Without this being a limitation on the scope of the present disclosure, described embodiments are particularly suited for cooled liquids, e.g., liquid natural gas (LNG).

One important advantage of a system according to the present disclosure for vertical high tanks may be that vertical pressure comprising large static components is supported separately from horizontal pressure, mainly induced by dynamic movement of the vessel.

An important feature for tanks for storing, for example, LNG, is that there is substantially no metallic contact between loaded tanks and the structure of the vessel. This may be important when the liquid that is to be transported has a temperature which is lower than common steel in ships may endure without degrading some of the material properties of such steel. The liquid that is to be transported may, for instance, be LNG having a typical storage temperature of about −160° C. Another typical liquid that may be transported is carbon dioxide ($CO_2$) having a typical storage temperature of −60° C. at a pressure of 600 kPa. All support forces from tank to the hull of the vessel are generally transferred as pure pressure straight through hardwood layers or synthetic materials having similar properties. It is important that the material in these layers have suitable temperature insulating properties and that they are able to withstand the pressure they are to be subjected to. Hardwood is a well suited material for this purpose, but there are synthetic materials available as well.

In a first example embodiment, the vessel is a ship equipped with number of cylinder shaped tanks being arranged vertically. A support system for cylinder shaped cargo tanks designed for cooled liquid gas in transport ships and storage ships is presented.

Figure 2:
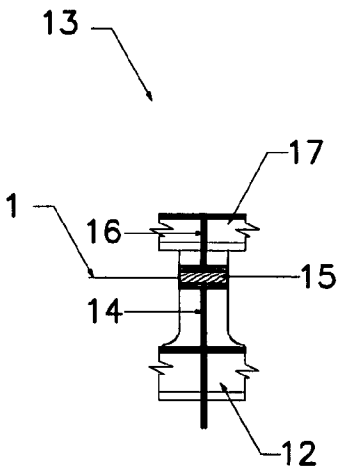
FIG. 2 depicts one of more vertical support elements for said tank.
Figure 1:
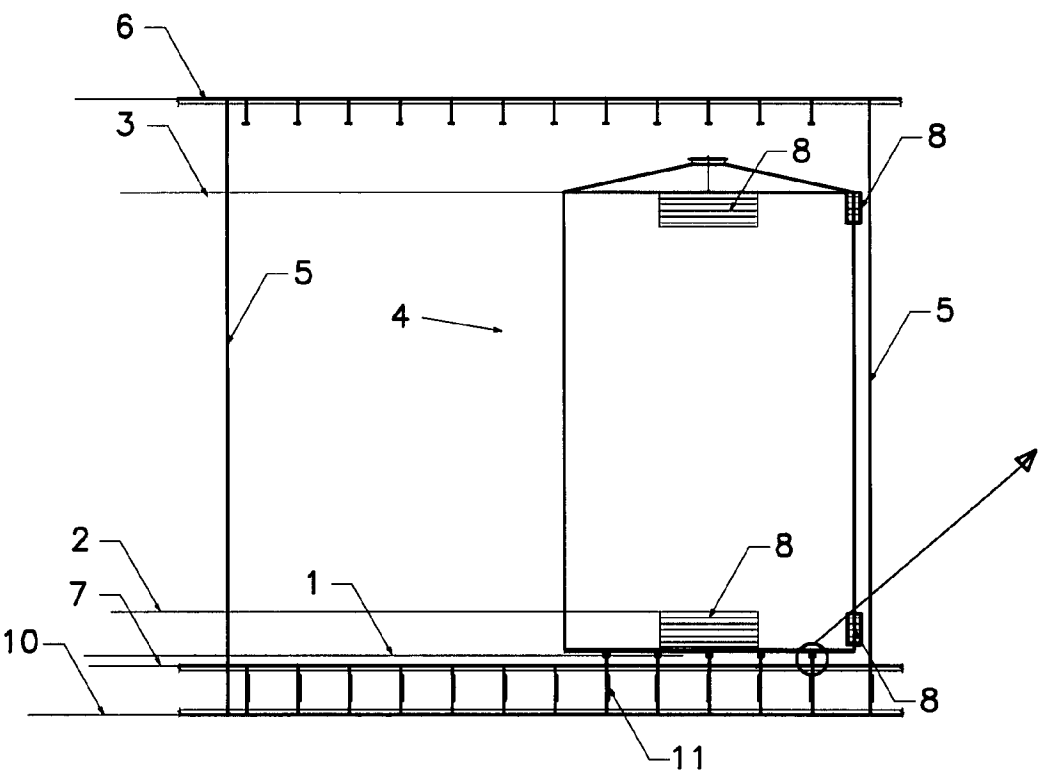
FIG. 1 depicts a simplified alongside vertical cross section of a vessel in which a vertical cylinder formed tank for liquids is visible.

FIG. 1 shows a typical alongside cross section of a hold for tanks in a gas carrier. Between two transverse bulkheads 5, for example, four such tanks may be arranged. All support forces in the present example are foreseen to be in three horizontal planes. The number of planes may be altered when desirable. In FIGS. 1 and 2, all vertical forces are supported using a suitable number of transverse webs 14. The number and the size of these webs 14 may depend upon the size of cargo tanks 4, 40 and the structure of the bottom of the ship, possibly a double bottom construction as may be required by regulatory authorities, and a main deck 6. The planes 2 and 3 may be arranged to support all horizontal forces including pitching moment.

FIG. 2 presents a typical detail from one of more vertical support elements 13 below the cargo tank 4, 40. The support element 13 may comprise a transverse web 14, welded to the inner bottom of a bulkhead 7 aligned with the main webs of the ship and a corresponding web 16 welded to the bottom of the cargo tank 4, 40. Between these two webs may be installed a bottom insulation layer 15 made of hardwood or a material with similar mechanical and thermal insulating properties. The webs may secured against tilting by means of the support elements 13 that may be aligned with double bottom stiffening ribs 12 in the bottom of the ship and a cargo tank bottom stiffener rib 17. The support elements 13 may support only vertical force and the bottom insulation layer 15 insulates the cargo tank 4, 40 from the structure of the ship.

The base of the vertical tank 4, 40 is generally flat and may be generally flexible. Underneath this base may be disposed a number of generally evenly distributed support elements. The pressure from the contents of the tank may be substantially evenly distributed to the support elements and further through the bottom structure of the vessel 41 and then to the water pressure on the outer bottom 10 of the vessel. In this way there no substantial bending moment is transferred from a tank to the structure of the vessel. If the tank bottom had a rigid construction, this would be difficult to achieve. Common self-supporting tanks known in the art prior to the present disclosure normally have support frames covering only part of the tank, e.g., in a ring underneath and covering the outer part of the base of the tank.

Figure 5:
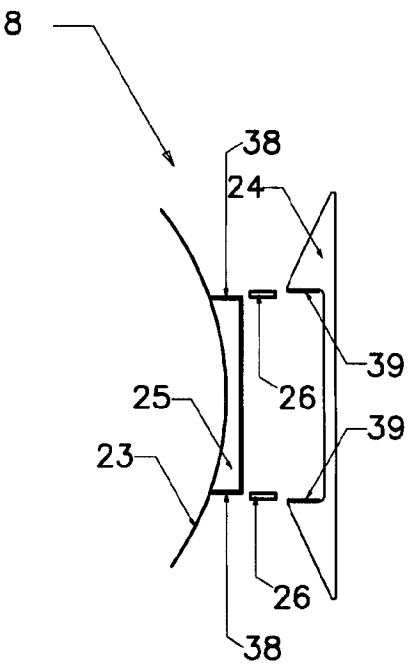
FIG. 5 depicts said support in exploded view.
Figure 4:
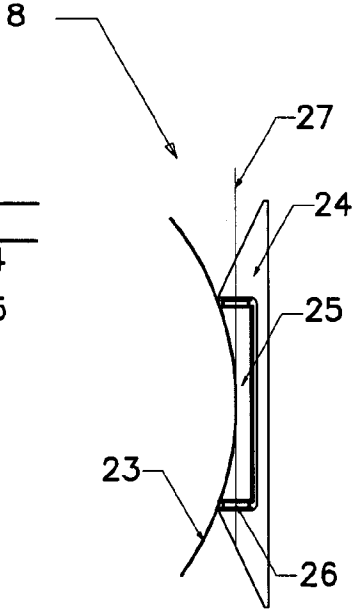
FIG. 4 depicts a support, a support point pair, preventing tangential movement of a tank.

The reference number in the drawings named "support point pair" 8 is a word structure shown in FIGS. 4 and 5. A support point pair 8 may comprise two main components, the first being a hull support pair 24 and the second being a tank support pair 25. The hull support pair 24 comprises a number of generally parallel profiles being welded or otherwise anchored to a transverse bulkhead 5 or to the hull of the ship 41, 141. Orthogonally to these profiles may be arranged two opposite surfaces of contact. The tank support pair 25 comprises, in a similar fashion, an number of generally parallel profiles being welded or otherwise anchored to the tank shell 23 of the cargo tank 4, 40, 104. Orthogonally to these profiles may also be arranged surfaces of contact on two opposite sides. Between the one surface of contact of the hull support pair 24 and the corresponding surface of contact of the tank support pair 25, an insulation layer 26 is arranged with a purpose of spreading the applied forces over the two surfaces of contact. A corresponding insulation layer 26 may be arranged between the remaining two surfaces of contact. With this construction, forces and reaction forces are supported in two opposite directions. In this example, the hull support pair 24 may be designed with an outer extension having a recess for receiving the inner extension of the tank support pair 25. A variation of this construction may be to swap the design of the hull support pair 24 and the tank support pair 25.

The number of support point pairs 8 in the planes 2 and 3 shown in the drawings may be minimized to two in each plane, but in some cases three or more may be more suitable. In principle, the least number of support points that are necessary to support horizontal movements of a vertical tank is four, preferably angularly separated by about 90 degrees, distributed in two planes. In this first embodiment, the construction is preferably carried out horizontal support point pairs 8. In FIGS. 17 to 21, with details from FIGS. 4 and 5, the construction of the presented cross sections are orthogonal to the presented forces that are acting. In these drawings one may observe that the support, with positive force, is carried out in such a way that a force in one direction, e.g., from the cargo tank 4, 40, 104, and upward in FIGS. 4 and 5, is directed toward the hull of the ship going from the tank pressure face 38, through the insulation layer 26; and further on to the hull pressure face 39. Assuming the pressure is directed the other way, from the cargo tank 4, 40, 104 and downward in FIG. 4; toward the hull of the ship, the pressure is directed from the lower tank pressure face 38, through the insulation layer 26 and further on to lower hull pressure face 39 further down in the same drawings.

Figure 3:
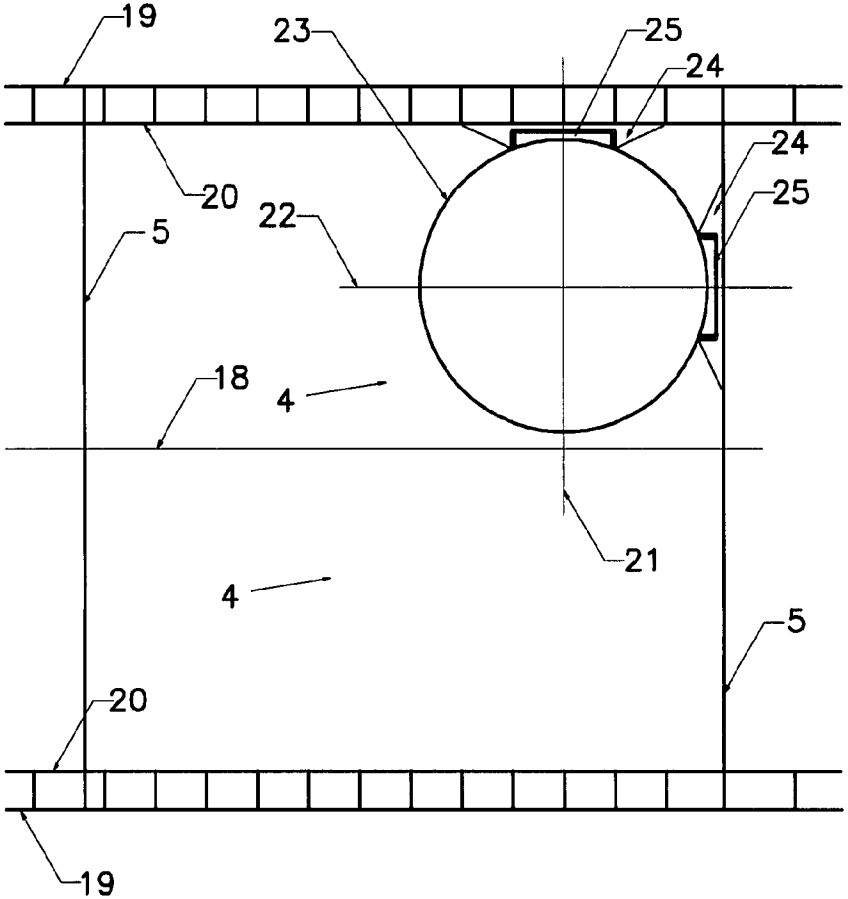
FIG. 3 depicts a simplified alongside horizontal cross section seen from above through said vessel in which the section also goes through a vertical tank shaped as a cylinder.

FIG. 3 presents a horizontal cross section through a typical hold and a typical cargo tank 4, 40. Just one cargo tank 4, 40 is shown in the drawing, but the number thereof may vary in other examples. FIG. 3 represents cross sections in both planes 2 and 3, these planes possibly being similar. Each plane will have at least two support point pairs 8, arranged with a mutual angle that is generally orthogonal, one of the support point pairs being designed to support alongside load and the other transverse load.

FIG. 4 shows a detail of a typical support point pair 8 and FIG. 5 shows the same detail in exploded view. A support point pair 8 may comprise a tank support pair 25, comprising a number of parallel faces, each being welded or fastened in some other way to a tank shell 23 of a cargo tank 4, 40, 104, possibly combined with ring stiffeners (not shown) on the tank. A compatible frame or hull support pair 24 with recess for the tank support pair 25 on the tank 4, 40, 104 may be welded to the inside of the ship side 19. The recess in the frame on the ship makes room for an insulation layer 26 made of hardwood (or other material having similar mechanical and thermal insulating properties) on each side. The insulation layer 26 is foreseen to transfer only general pressure, orthogonally to the faces of the insulation layer 26, so that the insulation layer 26 on the front side of a support point pair 8 receives loads that are directed forward, while the insulation 26 on the back side receives the loads that are directed backward.

Support point pairs 8 in this present embodiment address only horizontal forces while all vertical forces are transferred through the construction below plane 1. The support point pairs 8 are designed to be as long as required to accept a construction where a center in the reaction force from the ship is generally tangential to the middle of the tank shell 23. This results in that no torque is applied into the tank shell 23, but that the force goes tangentially directly into the tank shell 23 as pressure. This provides a substantially even distribution of stress in the tank shell 23.

Overturning or tipping is counteracted by the support point pairs 8 in plane 3 taking on more force than those in plane 2.

The construction has enough flexibility in the insulation layers 26, 15, to transfer substantially all forces, including forces from deformation, e.g. initiated by temperature variations and the moving of the ship 41, without undesirable stress being imparted upon the cargo tank(s) 4, 40 or the ship. The cargo tank(s) may expand or shrink freely in the radial direction without imparting to the corresponding support point pair 8 any additional force. This is particularly important when expecting substantial temperature variations as for, e.g., LNG.

Figure 7:
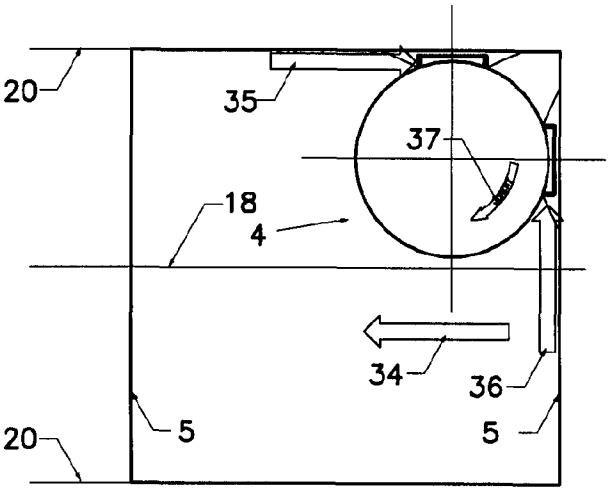
FIG. 7 is a somewhat simplified drawing similar to FIG. 3, the reaction forces from initially longitudinal forces are indicated.
Figure 8:
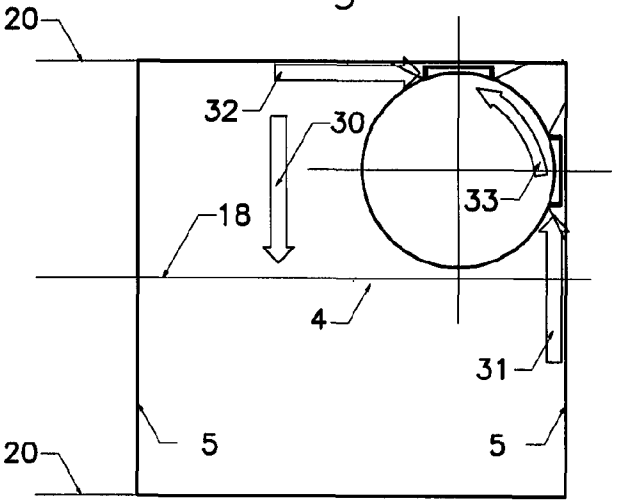
FIG. 8 is a drawing similar to FIG. 7, but in this the reaction forces from initially transversal forces are indicated.
Figure 6:
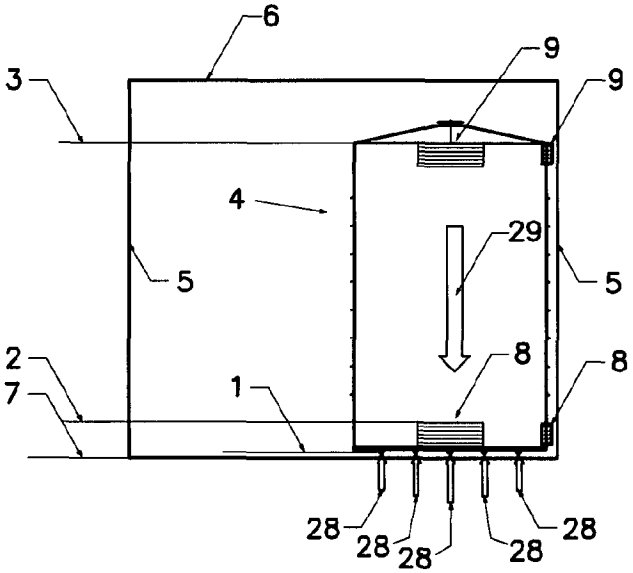
FIG. 6 is a somewhat simplified drawing similar to FIG. 1, the vertical forces being indicated.
Figure 9:
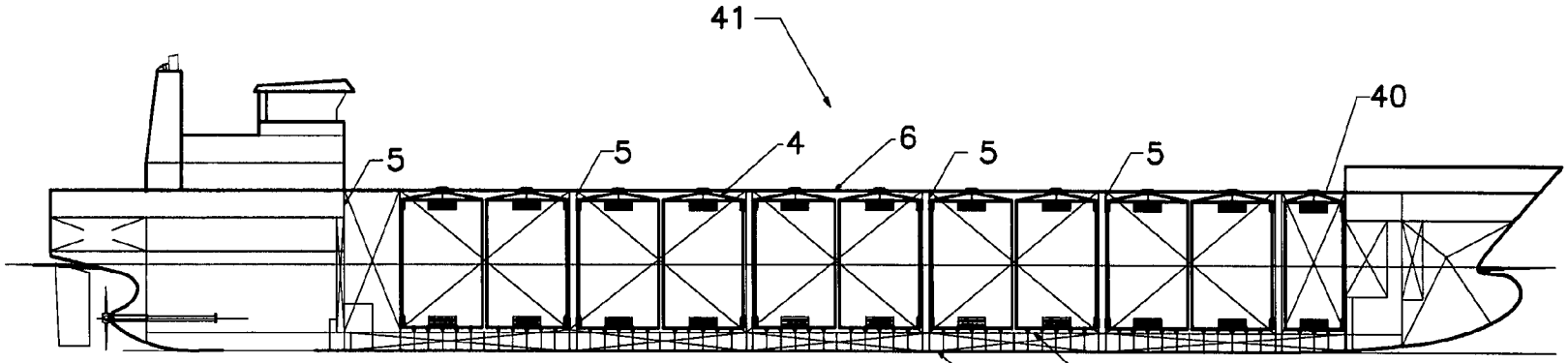
FIG. 9 depicts a longitudinal cross section through a vessel comprising vertically oriented tanks shaped as cylinders.
Figure 10:
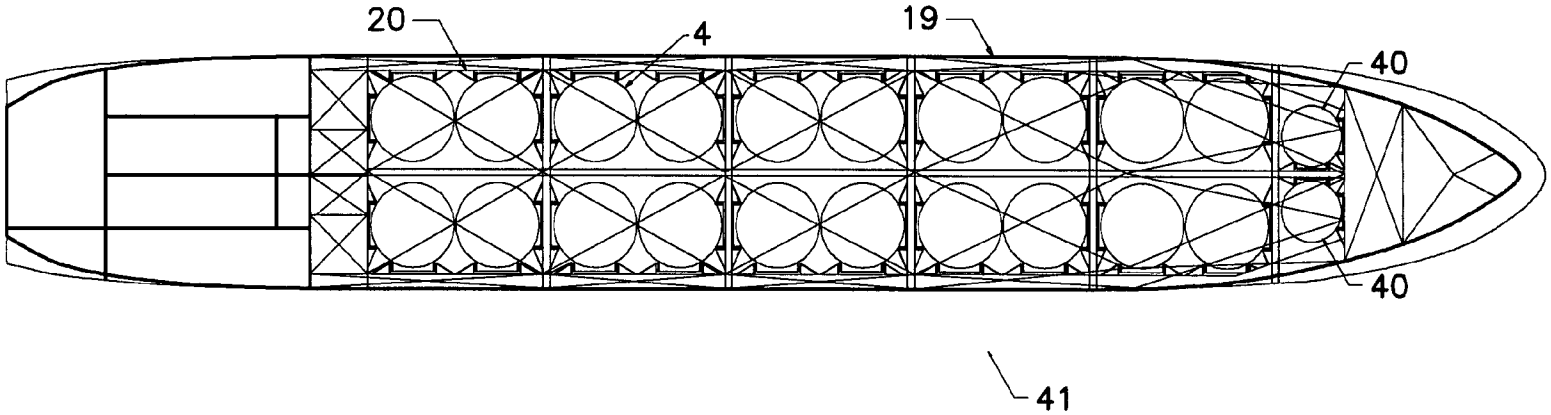
FIG. 10 is a sketch of a vessel seen from above and gives an overview of possible locations for placing of storage tanks for liquids.
Figure 11:
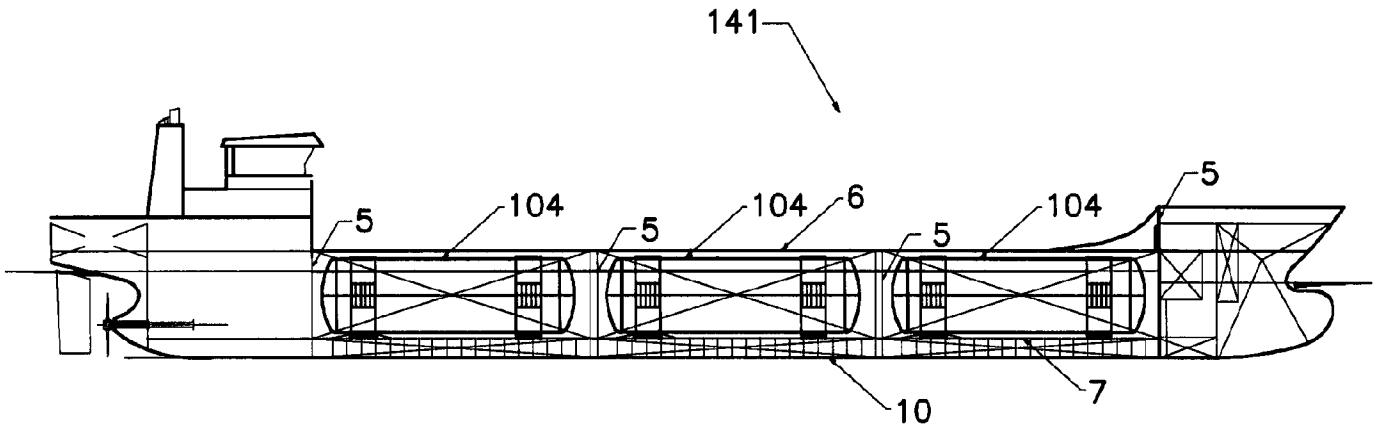
FIG. 11 depicts a longitudinal cross section through a vessel having horizontally located tanks shaped as cylinders.
Figure 12:
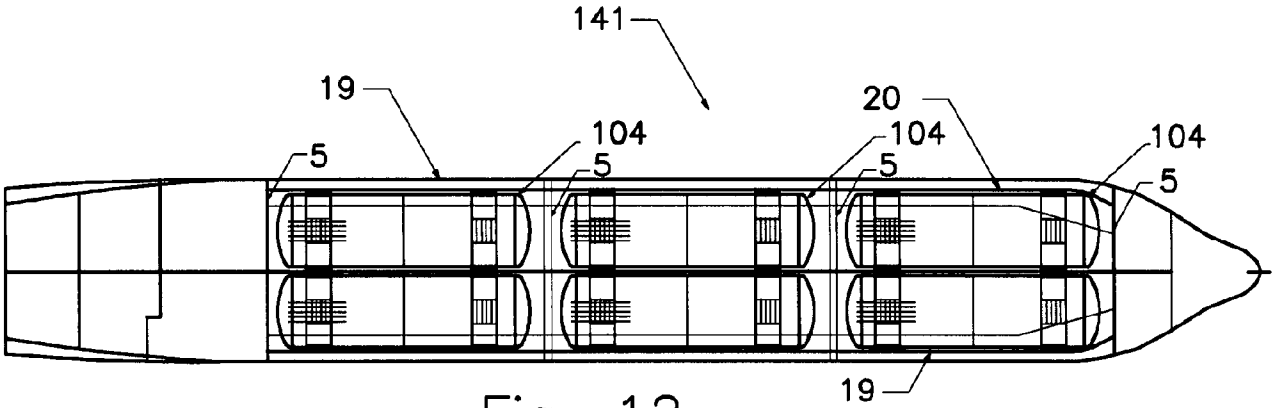
FIG. 12 is a sketch of a vessel seen from above and gives an overview of possible locations for horizontally oriented storage tanks.

FIGS. 6, 7 and 8 illustrate schematically how loads are transferred to the vessel hull. The total applied vertical load 29 may be transferred in plane 1 by the vertical support elements shown in FIG. 2. Horizontal static and dynamic loads may be transferred through the support point pairs 8 in planes 2 and 3.

When the cargo tank 4, 40 has applied thereto a horizontal transverse load 30 in the starboard direction as in FIG. 8 (for example due to the ship heeling over in starboard direction), the foregoing transverse load will generally be supported on the starboard side of the support point pair 8 arranged on the transverse bulkhead 5. The horizontal transverse reaction load 31 results in a rotating torque 33 applied to the tank 4, 40 that secondarily may be supported aft by the support point pair 8 arranged at the longitudinal bulkhead 20 on the ship side 19. This secondary reaction load is referenced by numeral 32. Part of the transverse loads are naturally be supported by the vertical support elements 13 having applied thereto an increased load on the starboard side compared to the port side.

Similarly, a horizontal side load 34 applied to the tank 4, 40 will be substantially supported by the support point pair 8 at the longitudinal bulkhead. The reaction load 35 will in this example result in a torque 37 applied to the tank 4, 40 which is supported by a secondary reaction load 36 in the support point pair 8 arranged at the transverse bulkhead 5.

Support point pair 8 in plane 3 may in such cases absorb substantially the whole load, and the support point pairs 8 in plane 2 will only contribute in extreme cases in which the whole of the tank is influenced to slide or move horizontally. If the support in plane 1 prevents the tank from sliding or moving horizontally, one omit arranging the support in plane 2.

Forces directed upward may appear if damage occurs and water gets into the hold outside a tank 4, 40. If the tank is exposed to water on the outside and the tank is not sufficiently filled so that it does not float, additional support point pairs 8 may be added to prevent the tank 4, 40 from floating inside the hold. This is not shown in the figures relating to this first embodiment, but reference is made to the following embodiments where this is described.

In a second example embodiment, the vessel is a ship equipped with a number of cylinder shaped tanks that are placed horizontally. The embodiment is a simple support system for lying cylinder shaped cargo tanks designed for cooled liquids in gas and storage ships. The cooled liquid may for instance be LNG.

Figure 13:
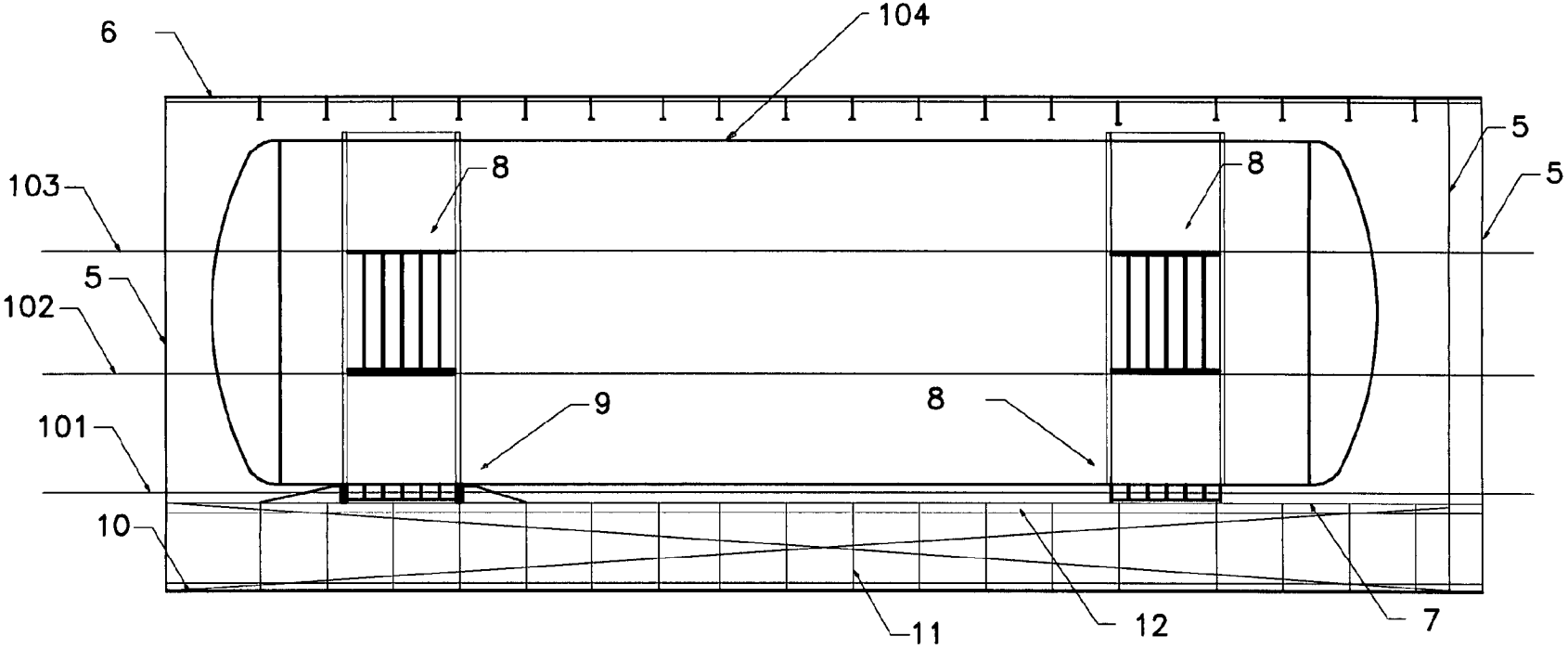
FIG. 13 depicts a longitudinal vertical cross section of a vessel in which a horizontal tank for liquids shaped as a cylinder is visible.
Figure 14:
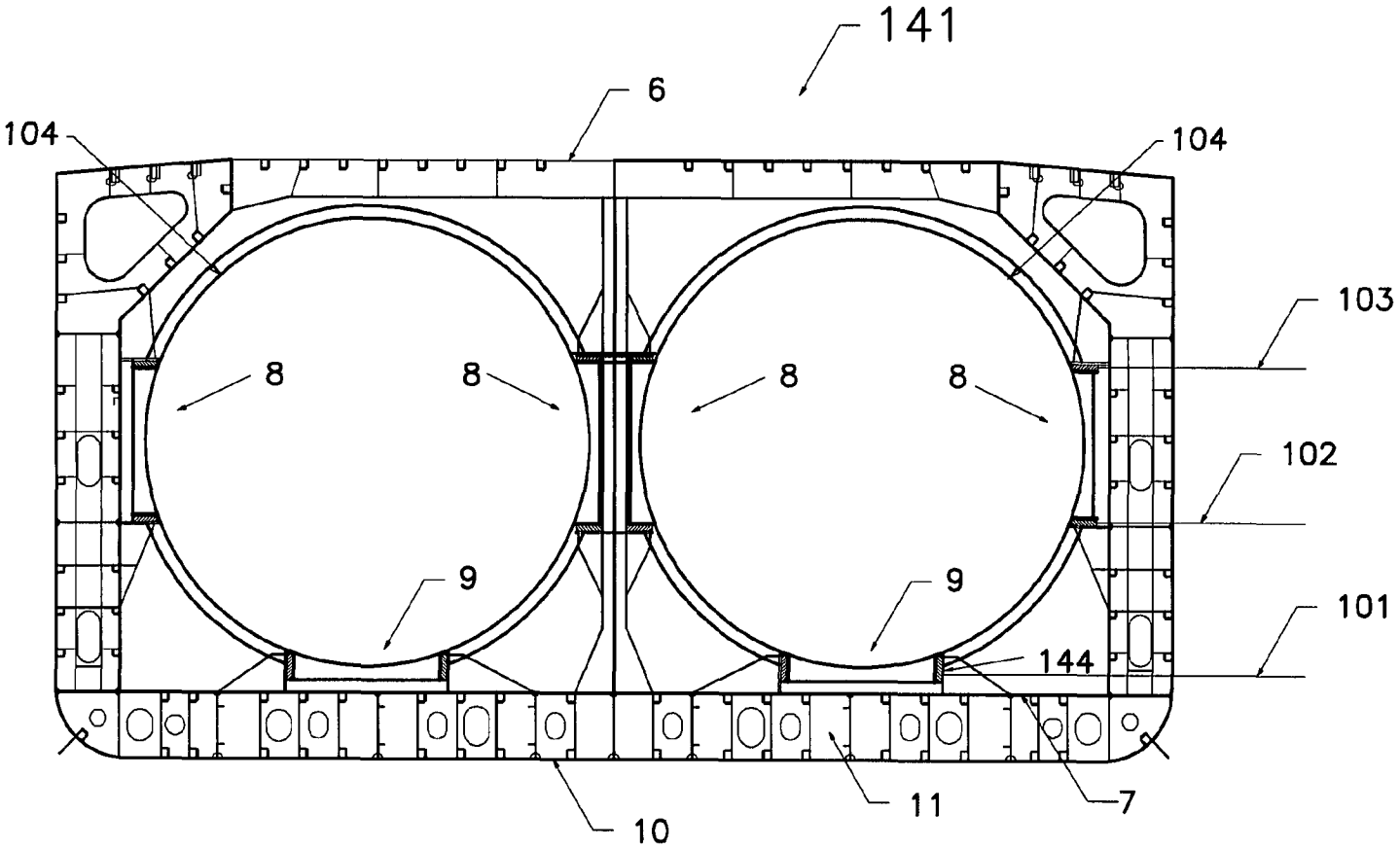
FIG. 14 is a vertical cross section crosswise through said vessel and showing two tanks for liquids and a typical arrangement of these.

FIG. 13 presents a typical longitudinal cross section of a hold in an LNG carrier. Between two transverse bulkheads 5 there may be arranged e.g. two cargo tanks 104. All support forces in this embodiment may be distributed or transferred in three planes. This may be changed on demand.

In the present embodiment a construction with support point quads 9 is used in addition to the construction with support point pairs 8 as described earlier herein.

Figure 16:
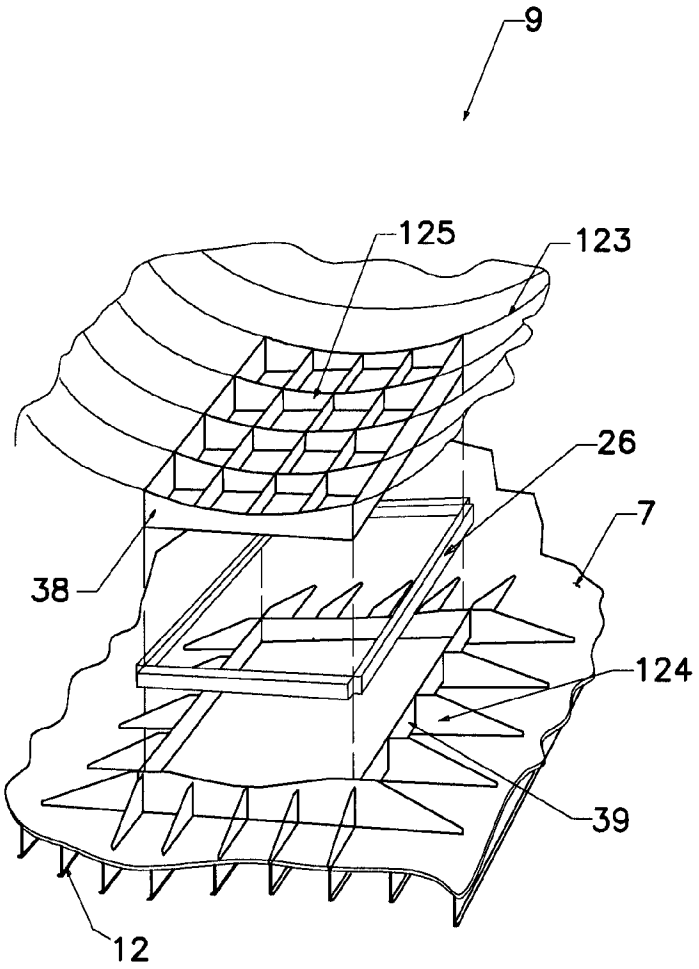
FIG. 16 depicts the support in FIG. 15 in perspective and exploded view.
Figure 15:
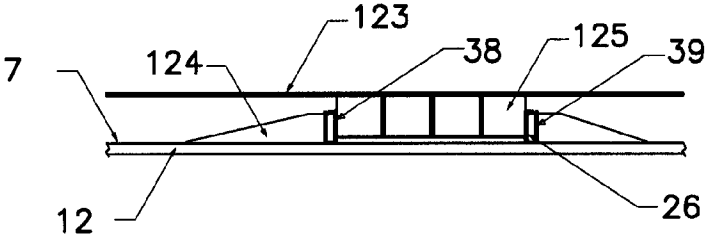
FIG. 15 depicts a support, a support point quad, for a tank shaped as a cylinder, for upholding horizontal forces in two orthogonal directions.

In FIGS. 15 and 16 the construction of a support point quad 9 is presented. It is constructed in a similar way as the support point pair 8, but it has in addition a corresponding support arrangement orthogonally to the support point pair 8 so that the combined construction supports loads and reaction loads in four directions generally orthogonally to each other. A person skilled in the art will observe that possible variations to this are feasible, for example, a construction with three symmetrical or asymmetrical directions. Another variation may be carried out with a circular version of the tank support and with a corresponding circular arrangement of the hull support. This is not shown on the drawings. Such variations may be a starting point for different embodiments that are not described further herein, but may be adapted to different movement patterns of vessels 41, 141 equipped with cargo tanks 4, 104 of different sizes and shapes. As a person skilled in the art will understand that all such embodiments and variations have insulation layers 26 corresponding to their tank pressure faces and hull pressure faces for transferring forces.

Support point pairs 8 may also be arranged on the fore and/or aft end surfaces of cargo tanks. This is not shown in the drawings or described further in the embodiments. The different support point pairs 8 in one vessel may not be designed equally, but may be adapted to different requirements.

The construction may be designed with flexibility and tolerances to handle all loads, including loads resulting from deformations, that may be initiated, e.g., by temperature variations and the movement of the vessel, without undesirable strain being transferred onto the cargo tank 4, 40, 104 or ship 41, 141. The cargo tank may in principle expand or shrink freely in its radial or axial direction without adding any additional strain to any of the support point pairs 8 or support point quads 9. This is important when the tanks may be large temperature variations as with e.g. LNG.

FIGS. 17-21 illustrate schematically how load is transferred between the tanks and the hull of the ship. The general force of gravity 129 is transferred in plane 102, as shown in FIGS. 17 and 18. Horizontal static and dynamic forces, 130, 134, are transferred through support point pairs 8 and through support point quads 9.

When the cargo tank 104 has a horizontal transverse load 130 applied toward starboard as in FIG. 21, e.g., because the ship is heeling over in starboard direction, with further reference to FIG. 13, such transverse load 130 will primarily be supported by a support point quad 9 and a support point pair 8 on the lower side of tank 104, where the included hull support quad 124 and the hull support pair 24 may be fastened to the inner bottom of the ship 7.

The horizontal transverse reaction load 131 in turn apply a rotating torque 133 to the tank resulting in a secondary reaction load 132 from the ship supported at the upper part of the support point pair arranged at the port side. Part of the applied horizontal transverse load 130 will be supported by vertical reaction forces 128 and will provide a larger load on the starboard side than on the port side of the vessel.

While vertical tanks may have a flexible base, horizontal tanks are generally completely self supporting. Both horizontal and vertical applied forces acting on big tanks 4, 40, 104 should be applied as close to the tank shell 23 as possible, preferably by letting the forces act along the middle of the shell 23, so that bending forces are not transferred into the tank. This may be obtained in the present example through the construction of the support point pair 8 and the support point quad 9, allowing the forces to act along the center line 27 of the support point pair and quad 8, 9 tangential to the center line of the tank 4, 40, 140. The length of the hull support pair 24, the hull support quad 124, the tank support pair 25 and the tank support quad 125 may vary to a large extent depending on the shape of the tank. It may even be split in separate halves for long designs, including long horizontal tanks.

FIG. 19 illustrates the upward directed forces 146 that may appear provided damage arises resulting in water seeping into the hold outside the tank. Provided the tank 104 subject to such forces is not filled sufficiently to preventing it from floating, the part of the support pair 8 that is in plane 103 will prevent the tank from floating inside the hold.

Support points in the present description is to imply a limited area for support and not a literal point.

REFERENCES

1, 2, 3, 101, 102, 103 Plane
4, 40, 104 Cargo tank
5 Transverse bulkhead
6 Main deck of ship
7 Inner bottom
8 Support point pair
9 Support point quad
10 Bottom shell
11 Double bottom structure
12 Double bottom longitudinals
13 Support element
14 Transverse web
15 Insulation layer
16 Transverse web
17 Cargo tank bottom stiffener
19 Ship side
20 Longitudinal bulkhead
23 Tank shell
24 Hull support pair
124 Hull support quad
25 Tank support pair
125 Tank support quad
26 Insulation layer
27 Centre line support load
28, 128 Vertical reaction force
29, 129 Total applied vertical load
30, 130 Total applied horizontal transverse load
31, 131 Primary horizontal transverse reaction load
32, 132 Secondary reaction load from ship
33, 133 Torque applied to tank
34, 134 Total applied horizontal longitudinal load
35, 135 Primary horizontal longitudinal reaction load
36, 136 Secondary reaction load
37, 137 Torque applied on tank

38 Tank pressure face
39 Hull pressure face
41, 141 Vessel
46, 146 Vertical lift up
47, 147 Vertical reaction force While the invention has been described with reference to a limited number of embodiments, those skilled in the art will readily devise other embodiments which do not exceed the scope of the present invention. Accordingly, the invention shall be limited in scope only by the attached claims.

What is claimed is:

1. System for support of a cargo tank (4, 40) in a vessel (41), comprising:

a cargo tank having a generally flat and generally flexible bottom;

substantially evenly distributed underneath the bottom of the tank are support elements (13); each comprising an insulation layer (15), wherein substantially all vertical force from the tank is transfer ras pressure generally evenly distributed from the contents of the tank, through the bottom structure of the vessel and on to water pressure exerted on an outer bottom (10) of the vessel (41);

the cargo tank (4, 40) comprising at least two pairs of tank pressure faces (38) fastened to a tank shell (23) of said tank wherein at least one pair of said tank pressure faces (38) is arranged transversely and wherein at least one pair of said tank pressure faces (38) is arranged longitudinally in the vessel (41);

an insulation layer (26) arranged proximate to each of the tank pressure faces;

a corresponding hull pressure face (39) arranged proximate to each of the insulation layers on the other side of each of the insulation layers (26), each hull pressure face fastened to a ship side (19) or to a bulkhead (5); and wherein each the tank pressure face (38) and the corresponding hull pressure face (39) is aligned so that an orthogonal line of force is directed generally tangentially to a middle of the tank shell (23) so that the insulation layers (15, 26) can transfer pressure without transferring substantial bending moment from the support loads to the cargo tank structure or to the bottom of the vessel and, at the same time, thermally insulate between the cargo tank and the vessel.

2. System for support of a cargo tank (4, 40) in a vessel (41) as claimed in claim 1, comprising:

between two and six pairs of tank pressure faces (38) fastened to the tank shell (23) of said tank and between one and four pairs of said tank pressure faces (38) are arranged transversally and between one and two pairs of said tank pressure faces (38) are arranged longitudinally in the vessel (41);

proximate to each of the tank pressure faces is arranged an insulation layer (26); and proximate to each of the insulation layers and on the other side of each of the insulation layers (26) is arranged a corresponding hull pressure face (39) that is fastened to a ship side (19) or to a bulkhead (5).

3. System for support of a cargo tank (4, 40) in a vessel (41) as claimed in claim 1, comprising:

six pairs of tank pressure faces (38) fastened to the tank shell (23) of said tank and four pairs of said tank pressure faces (38) are arranged transversally and two pairs of said tank pressure faces (38) are arranged longitudinally in the vessel (41);

proximate to each of the tank pressure faces is arranged an insulation layer (26); and proximate to each of the insulation layers and on the other side of each of the insulation layers (26) is arranged a corresponding hull pressure face (39) that is fastened to a ship side (19) or to a bulkhead (5).

* * * * *